US007926435B2

(12) United States Patent
Seo et al.

(10) Patent No.: US 7,926,435 B2
(45) Date of Patent: Apr. 19, 2011

(54) SPADE RUDDER

(75) Inventors: Young-hak Seo, Gyeongsangnam-do (KR); Sung-jin Kim, Gyeongsangnam-do (KR); Byeong-Seog Kang, Gyeongsangnam-do (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 0 days.

(21) Appl. No.: 12/067,159

(22) PCT Filed: Dec. 18, 2006

(86) PCT No.: PCT/KR2006/005532

§ 371 (c)(1),
(2), (4) Date: Mar. 17, 2008

(87) PCT Pub. No.: WO2007/073071

PCT Pub. Date: Jun. 28, 2007

(65) Prior Publication Data

US 2008/0229993 A1 Sep. 25, 2008

(30) Foreign Application Priority Data

Dec. 21, 2005 (KR) ..... 20-2005-0035915 U

(51) Int. Cl.
*B63H 25/38* (2006.01)

(52) U.S. Cl. ..... 114/165; 114/162

(58) Field of Classification Search ..... 114/162, 114/165, 169

See application file for complete search history.

(56) References Cited

U.S. PATENT DOCUMENTS

| | | | | | |
|---|---|---|---|---|---|
| 2,331,706 | A | * | 10/1943 | Livingston | 114/162 |
| 3,919,962 | A | * | 11/1975 | Clay | 114/169 |
| 4,024,827 | A | | 5/1977 | Becker | |
| 4,448,146 | A | | 5/1984 | Becker | |
| 2002/0051586 | A1 | | 5/2002 | Orndorff, Jr. et al. | |

FOREIGN PATENT DOCUMENTS

| | | | |
|---|---|---|---|
| DE | 44 26 953 | A1 | 2/1996 |
| DE | 103 35 485 | A1 | 3/2005 |
| EP | 0811552 | A1 | 12/1997 |
| GB | 21378 | A | 2/1910 |

(Continued)

OTHER PUBLICATIONS

English Language translations of the abstracts of DE 10335485 and DE 4426953 as cited in the Examination Report for corresponding European Patent Application No. 06 835 248.3.

(Continued)

*Primary Examiner* — Edwin Swinehart
(74) *Attorney, Agent, or Firm* — Locke Lord Bissell & Liddell, LLP

(57) ABSTRACT

Disclosed herein is a spade rudder, which is intended to relieve bending moment generated by a rudder, and to suppress vibrations generated from the rudder due to a propeller, in the case of a large ship. The spade rudder has a rudder stock for rotating a rudder, and a vertical bearing provided on a side surface of the rudder stock. The spade rudder further includes a stock gudgeon provided on a side surface of the vertical bearing, a horizontal bearing provided under the stock gudgeon, and a horizontal bearing housing provided at the junction of the rudder stock and the horizontal bearing, which are at right angles to each other, and dispersing a bending moment acting on the rudder.

3 Claims, 4 Drawing Sheets

FOREIGN PATENT DOCUMENTS

| | | | |
|---|---|---|---|
| GB | 2 150 517 | A | 7/1985 |
| GB | 2206324 | A | 1/1989 |
| JP | 2000-16393 | A | 1/2000 |

OTHER PUBLICATIONS

Examination Report for corresponding European Patent application No. 06 835 248.3, dated Jun. 21, 2010.

Examination Report for corresponding Japanese Patent Application No. 2008-528965, dated Aug. 25, 2010.

English Language translation of the abstract of Japanese Patent Application Publication No. 2000-16393 and the English Language translation of the text corresponding to the Examination Report for corresponding Japanese Patent Application No. 2008-528965.

* cited by examiner

[Fig. 1]
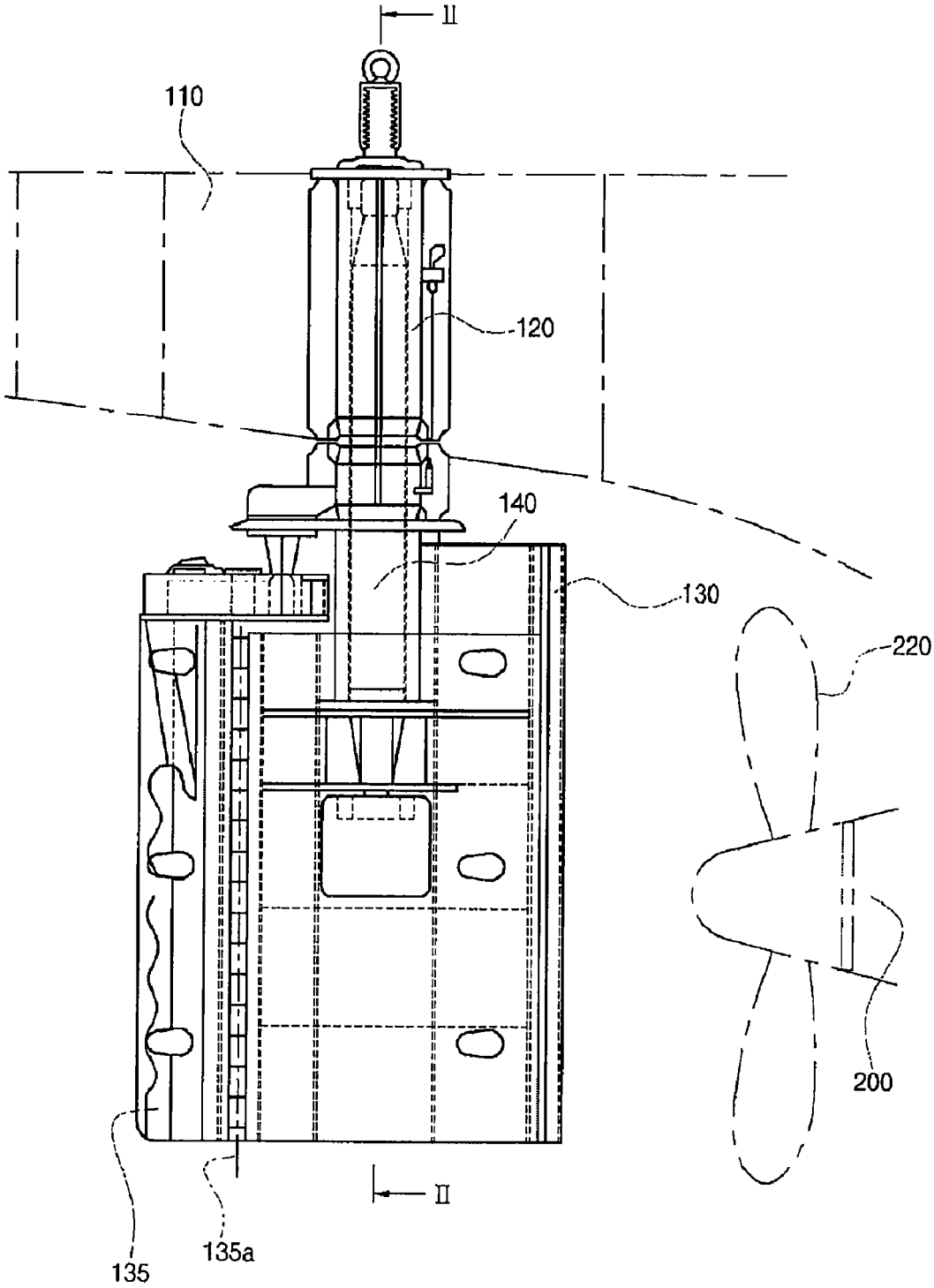
--Prior Art--

[Fig. 2]
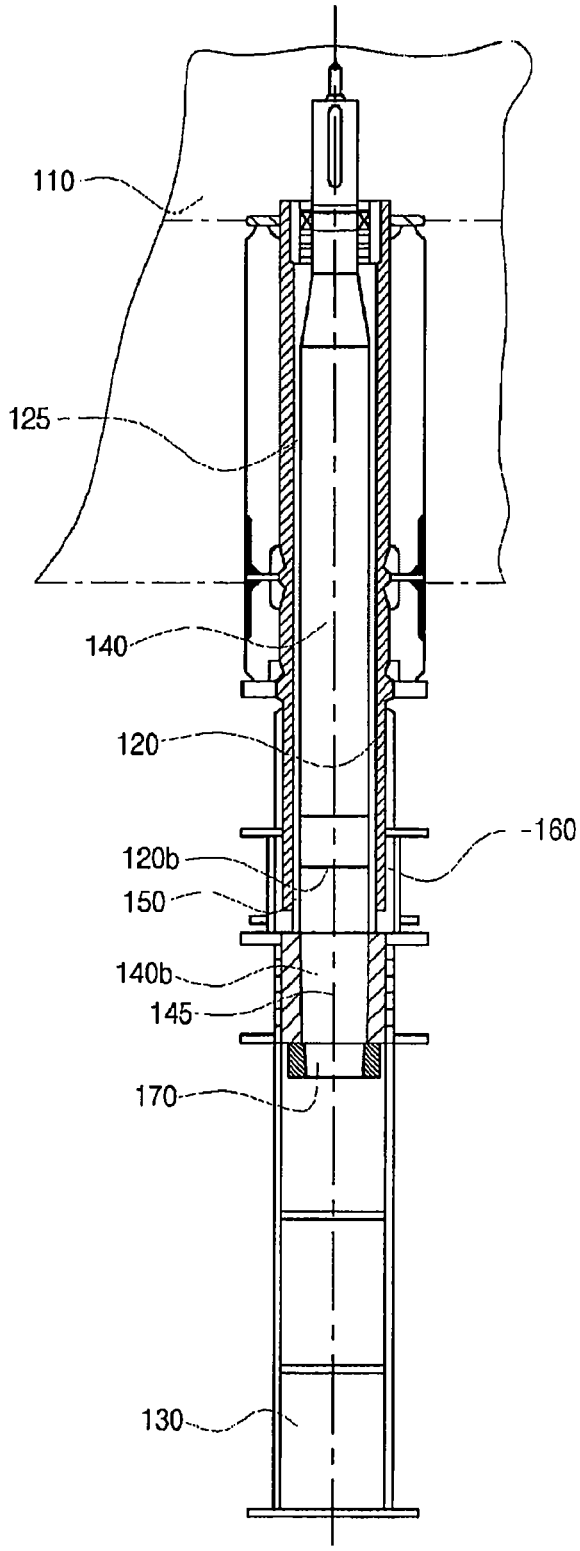
--Prior Art--

[Fig. 3]
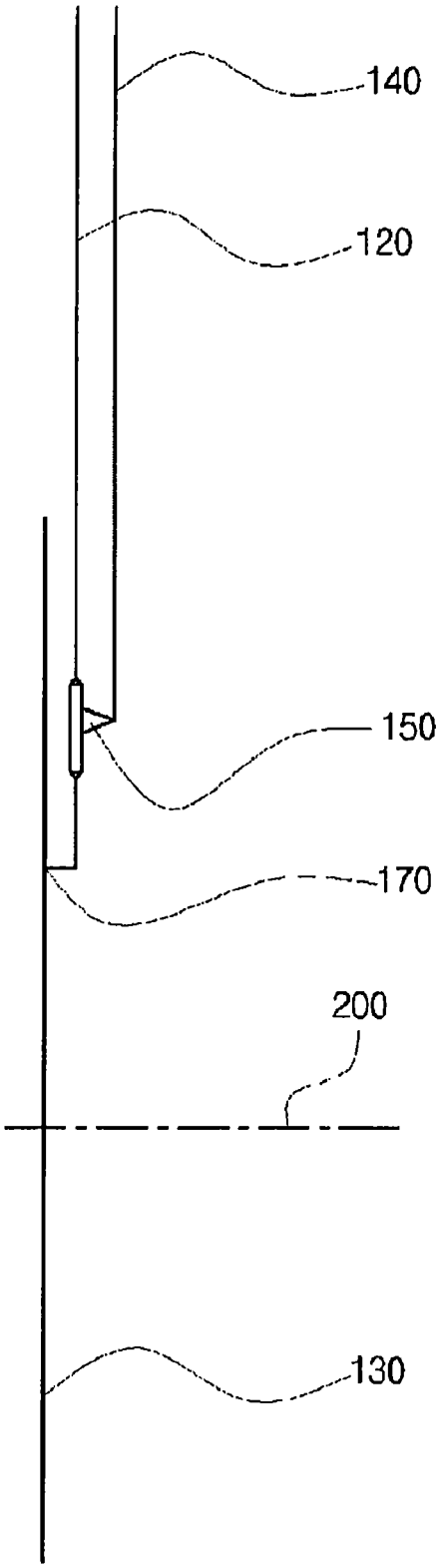
--Prior Art--

[Fig. 4]
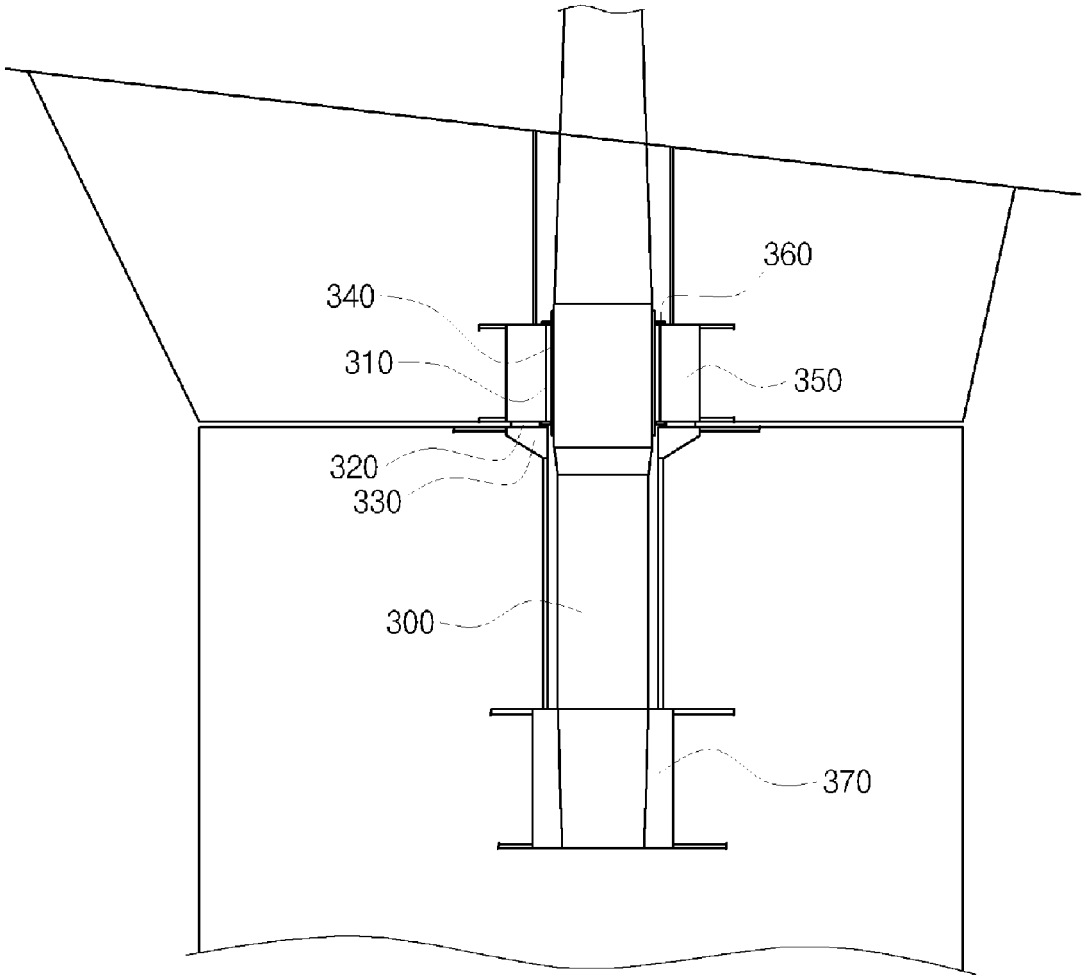

SPADE RUDDER

TECHNICAL FIELD

The present invention relates, in general, to a spade rudder and, more particularly, to a spade rudder, which is intended to relieve a bending moment generated by a rudder, and to suppress vibrations generated from the rudder due to a propeller, in the case of a large ship.

BACKGROUND ART

FIG. 1 is a side view showing a conventional rudder, in which a rudder stock is installed in a rudder stock trunk, and the position of the rudder stock secured to a rudder blade is set above the central line of a propeller shaft, FIG. 2 is a vertical sectional view taken along line II-II of FIG. 1, and FIG. 3 is a schematic view showing the placement of an inner bearing between the rudder stock and the rudder stock trunk according to the prior art, and the position of a coupling part of the rudder stock with the rudder blade.

In a balanced rudder for ships, as shown in FIGS. 1 to 3, part of a hull is denoted by reference numeral 110, a rudder stock trunk is denoted by reference numeral 120, a rudder blade is denoted by reference numeral 130, and a rudder stock is denoted by reference numeral 140. Further, reference numeral 220 denotes a propeller for propelling a ship, and a fin 135 is rotatably coupled to the rudder blade 130. Further, the rudder blade 130 functions to receive the lower end 120*b* of the rudder stock trunk 120, and preferably has a cylindrical cavity 160.

A central bore 125 is vertically formed in the cylindrical rudder stock trunk 120, which has the shape of a cantilever arm, and receives the rudder stock 140 therein. The rudder stock trunk 120 is secured at an inside end thereof to the hull 110, and extends into the rudder blade 130. The rudder blade is coupled to the end of the rudder stock 140. An inner bearing 150 is installed in the central bore 125, which is vertically formed in the rudder stock trunk, and supports the rudder stock 140 in the rudder stock trunk 120. Preferably, the bearing 150 is positioned in the lower end 120*b* of the rudder stock trunk 120. One end 145 of a lower portion 140*b* of the rudder stock 140 protrudes from the lower end of the rudder stock trunk 120 by a short distance. The tip 170 of the end 145 is coupled to the rudder blade 130. The coupling part of the rudder stock with the rudder blade has a general structure which allows the rudder blade 130 to be separated from the rudder stock 140 when a propeller shaft is replaced with another one. The coupling part of the rudder stock 140 with the rudder blade 130 is positioned above the central line 200 of the propeller shaft. Thereby, in order to disassemble the propeller shaft, a worker has only to remove the rudder blade 130 from the rudder stock 140.

That is, since the lower end 120*b* of the rudder stock trunk 120 and the lower portion 140*b* of the rudder stock 140 are positioned above the central line 200 of the propeller shaft, it is not necessary to remove the rudder stock 140 from the rudder stock trunk 120.

Further, the inner bearing 150 is installed in the rudder stock trunk 120 and supports the rudder stock 140. Preferably, the inner bearing 150 is placed in the lower end 120*b* of the rudder stock trunk.

Referring to FIG. 1, the fin 135, which is rotatably coupled to the rudder blade 130, is controllably rotated about a vertical axis line 135*a* by a general control driving unit. FIG. 3 schematically shows the position of the inner bearing 150, placed between the rudder stock 140 and the rudder stock trunk 120, and the position of the part of the tip 170 of the rudder stock that is coupled with the rudder blade relative to the central line 200 of the propeller shaft.

Such a balanced rudder for ships can be applied to all kinds of ships, including small ships and large ships. However, a structure for more efficiently stabilizing the bending moment of the rudder has been required. To this end, the problems of a construction including a vertical bearing must be overcome, and a structure for more efficiently stabilizing vibrations is required.

DISCLOSURE OF INVENTION

Technical Problem

Accordingly, the present invention has been made keeping in mind the above problems occurring in the prior art, and an object of the present invention is to provide a spade rudder for relieving bending moment, and suppressing vibrations caused by a propeller, in the case of a large ship.

Technical Solution

In order to accomplish the object, the present invention provides a spade rudder, having a rudder stock for rotating a rudder, and a vertical bearing provided on a side surface of the rudder stock, the spade rudder further including a stock gudgeon provided on a side surface of the vertical bearing; a horizontal bearing provided under the stock gudgeon; and a horizontal bearing housing provided at a junction of the rudder stock and the horizontal bearing, which are at right angles to each other, and dispersing a bending moment acting on the rudder.

The horizontal bearing housing may be cast steel or forged steel.

Further, the horizontal bearing may be a water-lubricated bearing or a dry running bearing.

ADVANTAGEOUS EFFECTS

As described above, a spade rudder according to the present invention includes a horizontal bearing and a horizontal bearing housing, in addition to a rudder stock and a vertical bearing provided in a hull according to the prior art, so as to support the rudder, thus relieving bending moment and suppressing vibrations of the hull caused by a propeller, in the case of a large ship.

BRIEF DESCRIPTION OF THE DRAWINGS

FIG. 1 is a side view showing a conventional rudder, in which a rudder stock is installed in a rudder stock trunk, and the position of the rudder stock secured to a rudder blade is set above the central line of a propeller shaft;

FIG. 2 is a vertical sectional view taken along line II-II of FIG. 1;

FIG. 3 is a schematic view showing the placement of an inner bearing between the rudder stock and the rudder stock trunk according to the prior art, and the position of a part of the rudder stock that is coupled with the rudder blade; and FIG. 4 is a detailed view showing a spade rudder, according to the present invention.

BEST MODE FOR CARRYING OUT THE INVENTION

FIG. 4 is a detailed view showing a spade rudder, according to the present invention. As shown in FIG. 4, a spade rudder provided on the lower portion of a hull includes a rudder stock 300, a vertical bearing 310, a horizontal bearing 320, and a horizontal bearing housing 330, thus supporting the rudder. The construction of the spade rudder will be described below in detail.

The rudder stock 300 is a shaft that transmits rotating force to the rudder, and is coupled to a stock coupling 370, thus rotating the rudder. The rudder stock 300 is made of forged steel.

The bearings reduce friction between the rudder stock 300 and other parts, and mainly use a water-lubricated bearing or a dry running bearing. The bearings include both the vertical bearing 310 and the horizontal bearing 320. Since various kinds of materials can be used for bearings, a material that sufficiently withstands force must be selected for the bearings. The vertical bearing 310 is provided on the side surface of the rudder stock 300, and the horizontal bearing 320 is provided under a stock gudgeon 350. Further, the horizontal bearing housing 330 is provided at the junction of the rudder stock 300 and the horizontal bearing 320, which are at right angles to each other, thus dispersing a bending moment acting on the rudder. Unless the horizontal bearing housing 330 is provided, the size of the rudder stock 300 must be increased to endure the bending moment.

Unlike the present invention, the conventional spade rudder does not have both the vertical bearing and the horizontal bearing, but has only the vertical bearing. Thus, a more stable structure, which is capable of supporting the rudder against bending moment and relieving vibrations of a ship, in the case of the large ship, has been required.

Thus, the spade rudder of the invention further includes the horizontal bearing 320 and the horizontal bearing housing 330, as well as the vertical bearing 310 provided in a conventional ship, thus relieving bending moment and vibrations of a ship.

A sleeve 340 surrounds the rudder stock 300 or is installed to the upper portion of the horizontal bearing housing so as to prevent the rudder stock 300 and the horizontal bearing housing from being damaged when the rudder stock rubs against the vertical bearing 310 or the horizontal bearing 320. The sleeve 340 is made of a stainless steel material which has high corrosion resistance to seawater and thus does not rust easily even if the sleeve is exposed to seawater. Preferably, SUS304 or S316L is used for the sleeve.

The stock gudgeon 350 is provided on the side surface of the vertical bearing 310 so that the hull can sufficiently endure force acting on the rudder stock 300. The stock gudgeon 350 is made of cast steel or forged steel.

A bearing stopper 360 prevents the vertical bearing 310 and the horizontal bearing 320 from moving vertically and horizontally.

The stock coupling 370 couples the rudder stock 300 with a rudder body, and integrates the rudder stock with the rudder body through a press-fitting method. The stock coupling 370 is made of cast steel or forged steel.

INDUSTRIAL APPLICABILITY

As described above, the present invention provides a spade rudder, which can be widely applied in the shipbuilding industry for building ships or naval structures that float on the sea.

The invention claimed is:

1. A spade rudder, having a rudder stock for rotating a rudder, and a vertical bearing provided on a side surface of the rudder stock, the spade rudder further comprising:

a stock gudgeon provided on a side surface of the vertical bearing;

a horizontal bearing provided under and adjacent to the stock gudgeon; and a horizontal bearing housing provided at a junction of the rudder stock and the horizontal bearing, which are at right angles to each other; and wherein the horizontal bearing housing disperses a bending moment acting on the rudder by communicating with the bottom of the horizontal bearing.

2. The spade rudder according to claim 1, wherein the horizontal bearing housing is cast steel or forged steel.

3. The spade rudder according to claim 1, wherein the horizontal bearing is a water-lubricated bearing or a dry running bearing.

* * * * *